United States Patent [19]

Lin et al.

[11] Patent Number: 5,014,615

[45] Date of Patent: May 14, 1991

[54] WATER STOP MODULE

[75] Inventors: Jiing-Kang Lin; Thaddeus A. Niemiro, both of Lisle, Ill.

[73] Assignee: Rockwell International Corporation, Pittsburgh, Pa.

[21] Appl. No.: 419,180

[22] Filed: Oct. 10, 1989

[51] Int. Cl.[5] ..... B41F 7/30; B41L 25/06

[52] U.S. Cl. ..... 101/147; 101/366

[58] Field of Search ..... 101/147, 148, 366, 365, 101/364, 363, 207–210; 239/222, 222.17, 222.19, 122; 118/313, 314, 300; 222/286, 291, 292, 544

[56] References Cited

U.S. PATENT DOCUMENTS 3,411,718 11/1968 Wagner ..... 101/147 X 3,749,313 7/1973 Weitmann ..... 101/148 X

*Primary Examiner*—J. Reed Fisher

[57] ABSTRACT

A water stop module for use with a spray nozzle printing press dampener includes a shield maintained in a housing having an aperture to allow undisrupted fluid flow therethrough and a guide track for directing the shield to block the aperture. A pair of cogwheels with sprockets in engaging relation with the shield are rotatable to drive the shield along the guide tracks by a regulated amount to enable the area of coverage of fluid emerging from the aperture to be determined.

14 Claims, 2 Drawing Sheets

WATER STOP MODULE

BACKGROUND OF THE INVENTION

1. Field Of The Invention

This invention relates to offset lithographic printing presses having a spray rail and series of spray nozzles for supplying fluid to the press during printing operations. More particularly, the invention relates to a fluid stop module that acts in cooperation with the spray rail to provide a shield that enables control of the area of coverage achieved by fluid exiting the spray nozzles such that the area of coverage corresponds to the width of the web of material being utilized in the printing press.

2. Description Of Prior Art

Lithography is the art or process of printing from a flat stone or metal plate. Lithography is distinguished from other forms of printing, in part, by the absence of the use of relief to distinguish between the areas to be printed and those to be left blank. The lithographic method is based upon the repulsion between immiscible liquids, such as oil-based inks, and water. The process begins by the etching of a design on a surface. A grease-like material that is attracted to the etched area is then applied to the surface and takes the form of the design. Water is then added to the surface. The greased areas repel the water which ensures that only the ungreased areas become water saturated. The printing ink subsequently applied will then be repelled by the ungreased water-saturated areas and absorbed by the greased areas. This creates the design in ink for transfer to a web.

To encourage an even coating of water for printing, water is generally introduced to a dampener roller and subsequently transferred to the printing plate. Various methods for applying water to a dampener have been utilized in offset lithographic presses. One method typically utilizes a spray rail which comprises a series of spray nozzles that direct water onto the dampener.

In order to properly saturate the dampener for adequate transfer of water to the printing plate, spray nozzles must span the width of the dampener. It is important that water is transferred to the printing plate over a large enough area to span the largest width web the printing press can handle. As a consequence, with fixed spray rails, when smaller widths of web are being utilized in printing, excess water is applied to the dampener and transferred to the press beyond the limits of the web. The excess water is not absorbed and has a tendency to flood the machinery.

As water is corrosive to some components of a printing press, this excess water can lead to premature corrosion, especially to the outer edges of the press and other exposed areas resulting in a significant reduction in the useful life of the press. As well as being detrimental to the machinery, excess water is also expelled from the press soaking press operators and other workers in the vicinity. Excess water is also deposited on the floor where it might precipitate an accident.

To reduce both corrosion of the press and danger to the workers, it is desirable to minimize the exposure of the press to excess water during operation. It is consequently desirable to be able to adjust the coverage area of fluid exiting the spray nozzles to provide a water film on the printing plate that corresponds to the width of the web of material being utilized in the printing press.

The fluid stop device of this invention achieves such a result. Regulation of the movement of a shield that blocks the flow of fluid from the spray nozzles allows adjustment of the width of the dampener moistened by fluid from a spray bar. A dial situated on top of the water stop module allows the operator to select the width limit of the spray to match the width of web on the press and thereby minimize the excess water in the press machinery.

OBJECTS OF THE INVENTION

Accordingly, it is an object of this invention to provide an improved printing press dampener that meets the aforementioned requirements.

It is a specific object of this invention to minimize excess fluid applied to a printing press during operation.

It is another object of this invention to provide a printing press dampener that can be adjusted to supply fluid only over the necessary portion of the width of the web.

It is a further object of this invention to provide a printing press which permits adjustability of the peripheral limit reached by fluid expelled from spray nozzles.

It is a yet further object of this invention to provide an adjustment of the area over which fluid is supplied to a printing press that can be applied to existing presses by only minor alterations to the press.

It is yet another object of this invention to provide a means to adjust the fluid flow of a spray rail in the downward spraying position.

SUMMARY OF THE INVENTION

In accordance with one embodiment of this invention, a water stop device for use with a spray nozzle printing press dampener which achieves the foregoing objects includes a shield member and guide means for directing the shield member into the path of fluid expelled from the spray nozzles of the printing press dampener. A drive means operates to extend the shield member along the guide means. The shield member acts to block fluid expelled from the spray nozzles. A control means regulates the extension effected by the drive means. The shield member is preferably retained in a housing having top and bottom members disposed in adjacent relation with a space therebetween to allow undisrupted passage of fluid from the spray nozzles. Grooved passages around the periphery of the housing form the guide means to direct the shield member. The shield member is preferably water proof tape that is moved between a position where it allows free flow of fluid onto a press dampener and a position where it completely blocks the flow of fluid onto the dampener.

The shield tape preferably has a series of apertures disposed along its length. The drive means is preferably a cog member that has a series of sprockets. The sprockets engage the apertures in the tape to move the shield tape along the grooves in response to rotation of the cog member. The apertures in the shield tape are preferably hidden within the grooves during extension of the tape so that fluid is not able to pass through the tape when the tape is in the blocking position. The cog member is therefore preferably comprised of two cogs each having a series of sprockets for engaging relation with the apertures that are arranged along the top and bottom of the shield tape. A scale plate attached to the cog wheels enables the extension of the shield tape to be regulated.

The fluid stop device can be utilized to vary the fluid coverage pattern in the spray down position by the inclusion of drip plates. The drip plates act to channel the fluid blocked from contact with the dampener in a direction away from the press into suitable drip chambers. This avoids the dripping of excess fluid onto the press.

Modules are preferably provided for each spray nozzle for the adjustment of the flow of fluid. For small variations in web width it may only be necessary to provide a module for the outermost spray nozzles. By providing a module for each of the spray nozzles on a spray rail, however, maximum flexibility in the pattern of fluid flow can be achieved.

BRIEF DESCRIPTION OF THE DRAWINGS

For a more complete understanding of this invention, reference should now be made to the embodiment illustrated in greater detail in the accompanying drawings and described by way of example only. In the drawings.

DETAILED DESCRIPTION OF THE DRAWINGS

Figure 1:
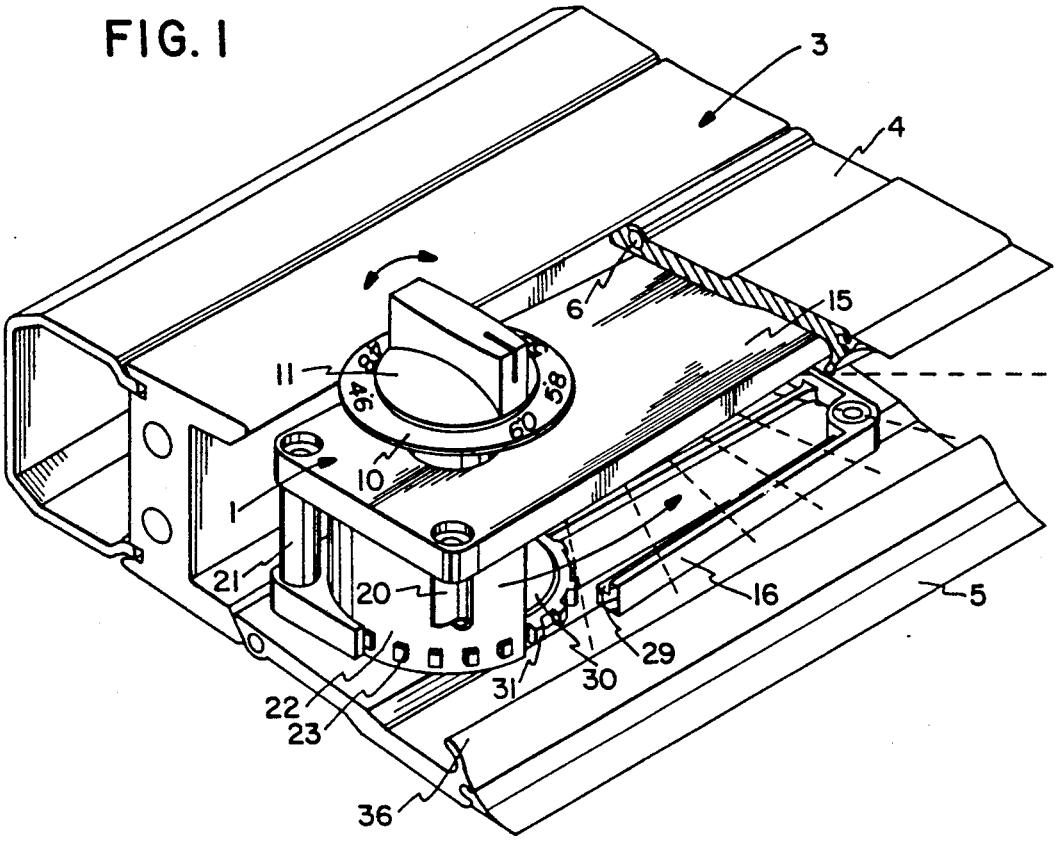
FIG. 1 is a perspective view of a water stop module with the upper shield shown cut away to disclose the module.
Figure 2:
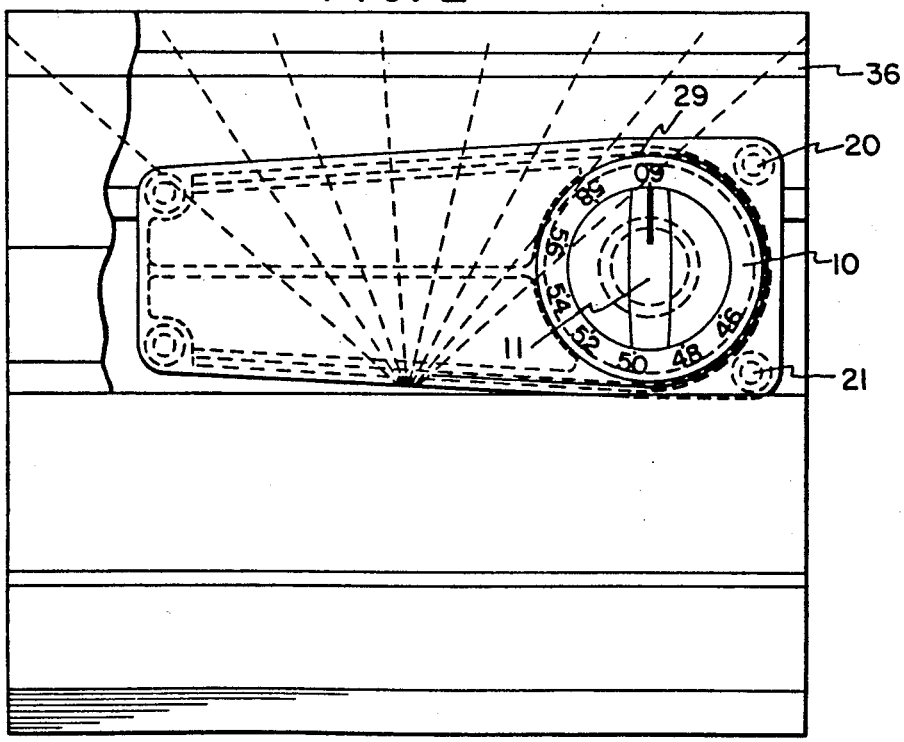
FIG. 2 is a top elevation of the water stop module of FIG. 1 with the skeleton structure of the bottom of the module shown in broken lines.
Figure 3:
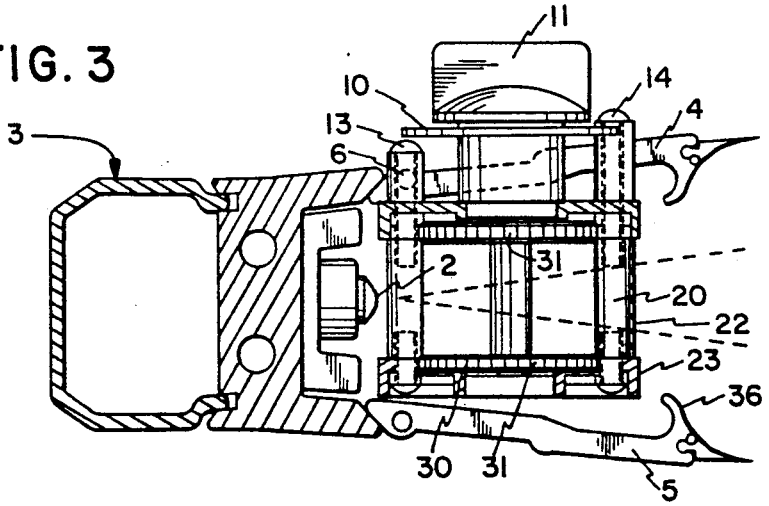
FIG. 3 is a sectional view through the water stop module of FIG. 1.
Figure 5:
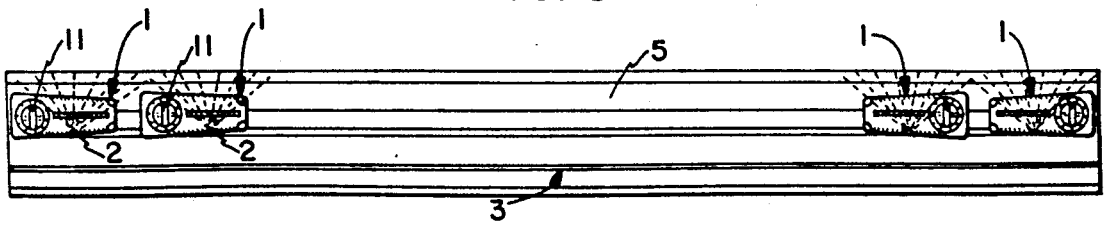
FIG. 5 is a schematic representation of a spray rail depicting modules in alignment with the outermost nozzles of the spray rail.

Turning to FIGS. 1, 2 and 3, a water stop module 1 is arranged for adjusting the spread of fluid, water from a spray nozzle 2 (seen most clearly in FIG. 3). The nozzle is positioned on a spray rail 3 to spray horizontally. The water stop module is positioned between upper and lower shields 4, 5. The upper shield 4 is shown cut away in FIG. 1 to reveal the module in position. As shown in FIGS. 2 and 3, the scale plate 10 and knob 11 are attached to a shaft 12 that passes through the upper shield 4 in order to facilitate access by the operator. The module 1 is attached to the upper shield 4 but not the lower shield 5. This permits ready access to the spray rail for maintenance by pivoting the upper shield 4 about pin 6, lifting both the upper shield 4 and the attached module 1 upwards. Bolts 13, 14 pass through both the top side 15 and the upper shield 4 to hold the module 1 in position. The bottom side 16 of the module 1 rests on the lower shield 5 to reduce the strain placed on the securing bolts.

The top and bottom sides are joined by supports 20, 21 located at one end of the module 1. These supports maintain an interval between the top and bottom sides 15, 16 that is sufficient to permit the undisrupted flow of water exiting the spray nozzle 2 through the module. A piece of shield tape 22 with a series of apertures 23, 24 along either edge is movable between retracted and extended positions. A pair of cog wheels 30, 31 have sprockets 32 that mate with the series of apertures 23, 24 along the edges of the shield tape. The cog wheels 30, 31 are joined by an axis 33 and are located to one side of the module where they do not interfere with fluid from the nozzle 2.

As the cog wheels rotate, the shield tape is moved from a retracted position, where it avoids obstruction of the flow of water from spray nozzle 2, to an extended position, where it can cause partial or total blockage of fluid flow. Rotation of the cog wheels is effected by turning the knob 11. The scale plate 10 indicates the degree of turn necessary to effect the required extension of the shield tape and is marked in accordance with the width of web used on a press.

As the shield tape extends across the module, the tape is held in position by tracks 29 in the top and bottom sides. The series of apertures falls below the level of the track thereby preventing the seepage of water through the apertures to wet the machinery. The shield tape is preferably fabricated from flexible non-corrosive material. The rest of the water stop module can also be fabricated primarily if not exclusively from plastic material and aluminum for corrosion resistance. The module is therefore very durable.

Water stopped by the shield tape collects in the module. The lip 36 prevents water from flowing onto the machinery and instead channels the water to a location where the excess can be drained. Water that is not stopped by the module passes between the top and bottom sides and makes contact with a dampener (not shown) that then transfers the water onto the web for printing.

Figure 4:
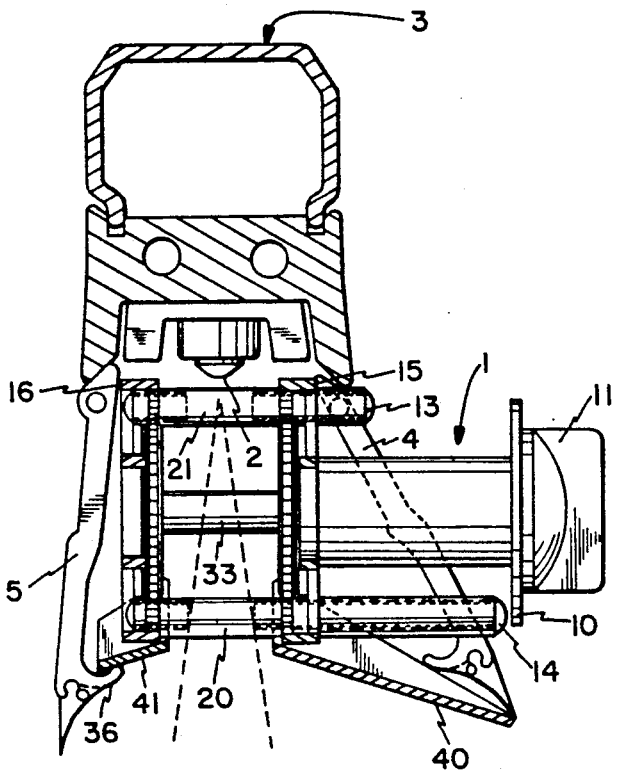
FIG. 4 is a sectional view through a water stop module adapted for use in the downward spraying position.

The water stop module illustrated in FIGS. 1–3 can also be utilized to stop water flow from a nozzle positioned so as to spray vertically downward. A spray rail 3 adapted for operation in the downward spraying position can be seen in FIG. 4. The water stop module is identical to that of FIG. 1 and like designations identify like parts. The module is however provided with additional drip pans to channel water away from the module and prevent it from trickling onto the dampener. A long drip pan 40 is located adjacent the side of the water stop module housing that accommodates the knob 11 and the scale plate 10. The extent of the drip pan is commensurate with the distance necessary to channel the water beyond the dampener. A shorter drip pan 41 is located at the other side of the housing. This short drip pan 41 channels excess fluid directly into the lip 36 of the shield 5. The lip channels the water to a location where it is drained. The screw 14 is extended to attach the module to the shield 4. The shaft 12 extends beyond the shield 14 for easy access to the knob 11 by the operator. Otherwise, the module can be fitted to a vertical spray rail in the same manner as to a horizontal rail.

Water stop modules of this invention are inexpensive and can be readily installed or replaced. Minimum alteration to the spray rail is necessary for installation. The module can be attached to shields already incorporated with the rail. This attachment requires minimum alteration to the shields with two holes being required for attachment by screws 13, 14 and a hole to accommodate the knob so that an operator can determine the degree of extension of the shield tape. In the vertical position, additional drip pans are required to channel water from the module. These modifications can straightforwardly be made to existing spray rails.

As many water stop modules as are required can be attached to a spray rail up to a maximum of one for each spray nozzle. For some applications, however, when the press is only used for certain width webs, it may only be necessary to provide a water stop module for the outermost nozzles.

While one preferred embodiment of this invention is illustrated, it will be understood, of course that the invention is not limited to this embodiment. Although the water stop modules described dimensioned to block water from only one nozzle, it would be possible to make larger modules that were able to block the flow of water from more than one nozzle if this was considered desirable. The device is also suitable for blocking fluids other than water that may be used in printing. Those skilled in the art to which the invention pertains may make modifications and other embodiments employing the principles of the invention, particularly upon considering the foregoing teachings.

What is claimed is:

1. A fluid stop device for use in a printing press comprising: at least one printing press dampener having at least one spray nozzle;

a flexible shield member;

guide means for directing said shield member into a path of fluid expelled from the at least one spray nozzle of the at least one press dampener;

drive means for extending said shield member along said guide and for at least partly winding up said flexible shield member to retract said flexible shield member from the path of the fluid; and means for controlling the extension of said shield member along said guide means to regulate the blockage of fluid expelled from the at least one spray nozzle of the at least one press dampener.

2. A fluid stop device for use in a printing press comprising: at least one printing press dampener having at least one spray nozzle;

a housing having an aperture for the passage of fluid therethrough from said at least one spray nozzle;

a flexible shield member movable between a retracted position avoiding blockage of said aperture and an extended position allowing blockage of said aperture;

guide means disposed in said housing for directing the shield member between said retracted and extended positions; and drive means for extending said shield along said guide means and for at least partly winding up said flexible shield member for retracting said shield member along said guide means to regulate the blockage of fluid expelled from the at least one spray nozzle of the at least one press dampener.

3. The fluid stop device of claim 2 wherein said housing comprises a top member and a bottom member, connection means for operably connecting said top and bottom member, said connection means maintaining said top and bottom members in spatially detached adjacent relation and defining said aperture therebetween.

4. The fluid stop device of claim 3 wherein said shield member is plastic shielding tape.

5. The fluid stop device of claim 4 wherein said guide means is a pair of grooves on the underside and top respectively of said top and bottom members, said grooves being in alignment and located along the peripheries of said top and bottom members.

6. The fluid stop device of claim 5 wherein said drive means comprises a cog member mounted in said housing, said drive means being disposed in engaging relation with said shielding tape.

7. The fluid stop device of claim 6, wherein said cog member comprises a pair of cog wheels each having radially extending peripheral sprockets, said sprockets being located within said housing one adjacent each of said top and bottom members, and wherein said shielding tape has a series of apertures along each of its edges, said apertures operatively disposed for mating engagement with said sprockets of said cog wheels.

8. The fluid stop device of claim 2, wherein said housing has at least one drainage hole.

9. The fluid stop device of claim 7, further comprising a calibrated knob operatively linked to said cog wheels, said knob allowing operator control of extension of said shield member.

10. A fluid stop device for use in a printing press comprising: at least one printing press dampener having at least one spray nozzle;

a top member;

a bottom member;

flexible shielding tape movable between a retracted position and an extended position;

connection means for maintaining said top and bottom members in spatially detached adjacent relation and defining an interval for passage of fluid therebetween;

guide means located on the periphery of each of said top and bottom members for directing said shielding tape into a path of fluid expelled from said at least one spray nozzle of the press dampener;

a rotatable cog member having sprockets located around its periphery for driving connection with said shielding tape, said flexible shielding tape at least partly winding around said cog member when said flexible shielding tape i retracted from the path of the fluid; and drive means for rotating said cog member to effect a predetermined extension of said shielding tape along said guide means to regulate the blockage of fluid expelled from the at least one spray nozzle of the at least one press dampener.

11. The device of claim 10, wherein said rotatable cog member comprises a pair of cogs each having radially extending peripheral sprockets, disposed between said top and bottom members, each respective one of said par of cogs being located adjacent each of said top and bottom members, and wherein said shielding tape has a series of apertures disposed in two rows along respective peripheral edges of said shielding tape for respective mating with said sprockets of said cogs.

12. The device of claim 10 wherein said drive means is a rotatable knob having scalar markings for selection of the required degree of extension of said shielding tape.

13. The fluid stop device of claim 10, wherein said fluid stop device has a housing at least partially about said top and bottom members and wherein said housing has at least one drainage hole.

14. The fluid stop device of claim 13, wherein said press dampener has at least one spray rail on which at least one spray nozzle is mounted, said spray rail being in a vertical position, said fluid stop module additionally comprising collecting channels for draining fluid for use with the spray rail in the vertical position.

* * * * *